US008176691B2

(12) United States Patent
Rasmussen et al.

(10) Patent No.: US 8,176,691 B2
(45) Date of Patent: May 15, 2012

(54) BEADED SOFFIT PANEL FOR BUILDINGS

(75) Inventors: C. Scott Rasmussen, Ada, MI (US); Paul W. Vander Laan, Hamilton, MI (US)

(73) Assignee: Quality Edge, Inc., Walker, MI (US)

( * ) Notice: Subject to any disclaimer, the term of this patent is extended or adjusted under 35 U.S.C. 154(b) by 611 days.

(21) Appl. No.: 12/276,950

(22) Filed: Nov. 24, 2008

(65) Prior Publication Data

US 2010/0126083 A1 May 27, 2010

(51) Int. Cl.
*E04D 13/00* (2006.01)

(52) U.S. Cl. ..... 52/95; 52/94; 52/302.1; 52/198; 454/260

(58) Field of Classification Search ..... 52/94, 95, 52/96, 302.1, 536, 537, 539, 558, 198, 199, 52/302.3; D25/123, 125; 454/250, 260, 454/270, 271, 367
See application file for complete search history.

(56) References Cited

U.S. PATENT DOCUMENTS

| | | | | | |
|---|---|---|---|---|---|
| 171,881 | A | | 1/1876 | Stinson | |
| 764,989 | A | | 7/1904 | Chester | |
| 1,826,082 | A | * | 10/1931 | Mastick | 52/519 |
| 2,918,996 | A | * | 12/1959 | Brown | 52/522 |
| 3,111,788 | A | * | 11/1963 | Ouellet | 52/537 |
| 3,256,654 | A | | 6/1966 | Pinckney, Jr. | |
| 3,417,519 | A | | 12/1968 | Hitter | |
| 3,496,691 | A | | 2/1970 | Seaburg et al. | |
| 3,724,149 | A | | 4/1973 | Detman | |
| 3,760,549 | A | * | 9/1973 | Silberkuhl et al. | 52/630 |
| 4,106,249 | A | * | 8/1978 | Morton | 52/336 |
| 4,251,970 | A | * | 2/1981 | Home | 52/674 |
| 4,295,316 | A | * | 10/1981 | Carlson | 52/588.1 |
| 4,347,691 | A | | 9/1982 | Lloyd-Jones | |
| 4,562,678 | A | * | 1/1986 | Carroll et al. | 52/302.3 |
| 4,607,753 | A | | 8/1986 | Radek | |
| 4,658,552 | A | | 4/1987 | Mulford | |
| 4,675,238 | A | * | 6/1987 | Karoubas | 428/599 |
| 5,165,213 | A | * | 11/1992 | Finch et al. | 52/588.1 |
| 5,172,527 | A | | 12/1992 | Ault | |
| 5,195,283 | A | | 3/1993 | MacLeod et al. | |
| 5,243,793 | A | | 9/1993 | MacLeod et al. | |
| 5,312,295 | A | * | 5/1994 | Young | 454/48 |
| 5,551,204 | A | * | 9/1996 | Mayrand | 52/795.1 |
| 5,718,086 | A | | 2/1998 | Dunn | |
| 5,782,000 | A | | 7/1998 | Bednar | |
| D404,504 | S | * | 1/1999 | Dickey | D25/125 |
| 5,937,592 | A | | 8/1999 | Tamlyn | |
| 5,941,028 | A | | 8/1999 | Hicks | |
| 6,112,490 | A | | 9/2000 | Meyer | |
| 6,145,255 | A | | 11/2000 | Allaster | |
| 6,223,488 | B1 | * | 5/2001 | Pelfrey et al. | 52/302.1 |

(Continued)

*Primary Examiner* — Robert Canfield
*Assistant Examiner* — Matthew Gitlin
(74) *Attorney, Agent, or Firm* — Price Heneveld LLP

(57) ABSTRACT

A beaded soffit panel and related method for buildings and the like includes a plurality of generally flat, imperforate base portions shaped to enclose at least a portion of the soffit when the soffit panel is mounted in a generally horizontal orientation under the eave. A plurality of generally M-shaped, contoured beads extend between the base portions, and have oppositely inclined sidewalls with center walls therebetween to create a decorative appearance on the soffit panel. A plurality of narrow vent slits extend through the exterior faces of the bead sidewalls at a predetermined acute angle to define angled tabs that extend inwardly, whereby when the soffit panel is installed, vision through the vent slits from a position generally underneath the eave is substantially blocked by the angled tabs.

19 Claims, 5 Drawing Sheets

U.S. PATENT DOCUMENTS

| | | | | |
|---|---|---|---|---|
| 6,516,577 | B2 * | 2/2003 | Pelfrey et al. | 52/302.1 |
| 6,647,675 | B1 * | 11/2003 | Castellanos | 52/198 |
| 6,913,530 | B2 | 7/2005 | Morris et al. | |
| 6,941,707 | B2 | 9/2005 | Sigmund | |
| 7,137,224 | B2 | 11/2006 | Rasmussen et al. | |
| 7,594,362 | B2 * | 9/2009 | Sigmund et al. | 52/96 |
| 7,739,840 | B1 * | 6/2010 | Castellanos | 52/57 |
| 2002/0020125 | A1 * | 2/2002 | Pelfrey et al. | 52/302.1 |
| 2002/0072324 | A1 | 6/2002 | Strait | |
| 2002/0124484 | A1 | 9/2002 | Martin | |
| 2004/0216397 | A1 | 11/2004 | Sigmund | |
| 2005/0072082 | A1 * | 4/2005 | Sigmund et al. | 52/302.1 |
| 2007/0151176 | A1 * | 7/2007 | Mumaw et al. | 52/198 |
| 2007/0234650 | A1 * | 10/2007 | Coulton et al. | 52/95 |

* cited by examiner

BEADED SOFFIT PANEL FOR BUILDINGS

BACKGROUND OF THE INVENTION

The present invention relates to building construction, and in particular to a beaded soffit panel and related method for buildings and the like.

Soffit panels are generally well known in the art, and serve to cover or enclose the underside of the eaves of homes and other buildings of the type having roof eaves which extend beyond and hang over the outside walls of the building. The purpose of the soffit panels is to hide the eaves from view, and prevent the use of the underside of the eaves as a nesting place for insects, birds and the like. In modern day building construction, the soffit is normally vented to allow outside air to flow into the attic of the building to equalize the attic temperature and pressure with that of the outside environment. This equalization helps to prevent degradation of the roof, reduce moisture accumulation, and improve the heating and cooling efficiency for the building interior. Beaded soffit panels are also used extensively to create a decorative external appearance underneath the eaves.

While some soffit panels are perforated or louvered to facilitate venting, they possess certain drawbacks. One such disadvantage is that insects, such as bees, bugs and the like, can get through the vents and use the soffit as a nesting place. Debris can also become lodged in the vents to impede the free flow of air into the eaves. Furthermore, such prior soffit panels normally have exposed or visible vent openings, thereby detracting from the overall appearance of the structure. The venting of beaded soffit panels in a manner which preserves their decorative appearance is particularly problematic. Consequently, a beaded soffit panels which overcomes these problems would be advantageous.

SUMMARY OF THE INVENTION

One aspect of the present invention is a beaded soffit panel for building roofs and the like, which includes a plurality of generally flat, integrally formed imperforate base portions extending longitudinally along the soffit panel, with opposite sides thereof arranged in a mutually parallel, laterally spaced apart and coplanar relationship to enclose at least a portion of the soffit when the soffit panel is mounted in a generally horizontal orientation under the eave. The soffit panel also includes a plurality of generally M-shaped, integrally formed, contoured bead portions disposed between the opposite sides of the base portions and having pairs of generally flat, oppositely inclined sidewalls with exterior and interior faces, and center walls extending between the sidewalls to create a decorative external appearance on the soffit panel. A plurality of integrally formed, narrow, elongate vent slits, configured to permit ambient air to flow therethrough to vent the eave, extend through the exterior faces of the sidewalls of the bead portions at a predetermined acute angle therewith to define angled tabs that extend inwardly from the interior faces of the sidewalls at the predetermined acute angle relative to the sidewalls, whereby when the soffit panel is installed in a generally horizontal orientation, vision through the vent slits from a position generally underneath the eave is substantially blocked by the angled tabs.

Another aspect of the present invention is a beaded soffit panel for building roofs and the like, comprising a plurality of generally flat, integrally formed imperforate base portions extending longitudinally along the soffit panel, with opposite sides thereof arranged in a mutually parallel, laterally spaced apart and coplanar relationship to enclose at least a portion of the soffit when the soffit panel is mounted in a generally horizontal orientation under the eave. A plurality of integrally formed, contoured bead portions are disposed between the opposite sides of the base portions and have pairs of generally flat, oppositely inclined sidewalls with exterior and interior faces, and center walls extending between the sidewalls to create a decorative external appearance on the soffit panel. A plurality of integrally formed, narrow, elongate slits, configured to permit ambient air to flow therethrough to vent the eave, extend through the exterior faces of the sidewalls at a predetermined acute angle therewith to define angled tabs that extend inwardly from the interior faces of the sidewalls at the predetermined acute angle relative to the sidewalls.

Yet another aspect of the present invention is a method for making a beaded soffit panel for building roofs and the like of the type having at least one eave with a soffit thereunder. The method includes forming an elongate strip of sheet metal, and integrally forming in the strip a plurality of generally flat, imperforate base portions extending longitudinally along the strip, with opposite sides thereof arranged in a mutually parallel, laterally spaced apart and coplanar relationship to enclose at least a portion of the soffit when the soffit panel is mounted in a generally horizontal orientation under the eave. The method also includes integrally forming in the strip a plurality of generally M-shaped, contoured bead portions disposed between the opposite sides of the base portions and having pairs of generally flat, oppositely inclined sidewalls with exterior and interior faces, and center walls extending between the sidewalls to create a decorative exterior appearance on the soffit panel. The method also includes forming a plurality of narrow, elongate vent slits through the exterior faces of the sidewalls at a predetermined acute angle to define angled tabs that extend inwardly from the interior faces of the sidewalls at a predetermined acute angle relative to the sidewalls, whereby when the soffit panel is installed in a generally horizontal orientation, vision through the vent slits from a position generally underneath the eave is substantially blocked by the angled tabs.

Yet another aspect of the present invention is a method for venting building roofs and the like of the type having at least one eave with a soffit defined thereunder. The method includes forming a plurality of vented soffit panels, each having a plurality of generally flat, integrally formed imperforate base portions extending longitudinally along the soffit panel, with opposite sides thereof arranged in a mutually parallel, laterally spaced apart and coplanar relationship to enclose at least a portion of the soffit when the soffit panel is mounted in a generally horizontal orientation under the eave. The method further includes forming a plurality of generally M-shaped, integrally formed, contoured bead portions disposed between the opposite sides of the base portions and having pairs of generally flat oppositely inclined sidewalls with exterior and interior faces, and center walls extending between the sidewalls to create a decorative external appearance on the soffit panel. The method further includes a plurality of integrally formed, narrow, elongate vent slits configured to permit ambient air to flow therethrough to vent the eave, and extending through the exterior faces of the sidewalls at a predetermined acute angle therewith to define angled tabs that extend inwardly from the interior faces of the sidewalls at the predetermined acute angle relative to the sidewalls. Finally, the method includes installing the soffit panels in a side-by-side, generally horizontal position under the eave, such that the eave is enclosed, and vision through the vent slits in the sidewalls of the bead portions is substantially blocked by the angled tabs when viewed from a position underneath the eave.

Another aspect of the present invention is a beaded soffit panel having vent slits with internally protruding tabs that obscure the vent slits from view when observed from a position underneath the eaves so as to provide approved aesthetics, yet prevent insects, bugs and other debris from entering the soffit or eave. The vented soffit panel has an uncomplicated design, is easy to install, and is economical to manufacture. Preferably, the vented soffit panel is constructed from microlanced, roll formed aluminum or the like to provide a very lightweight, yet durable, product.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
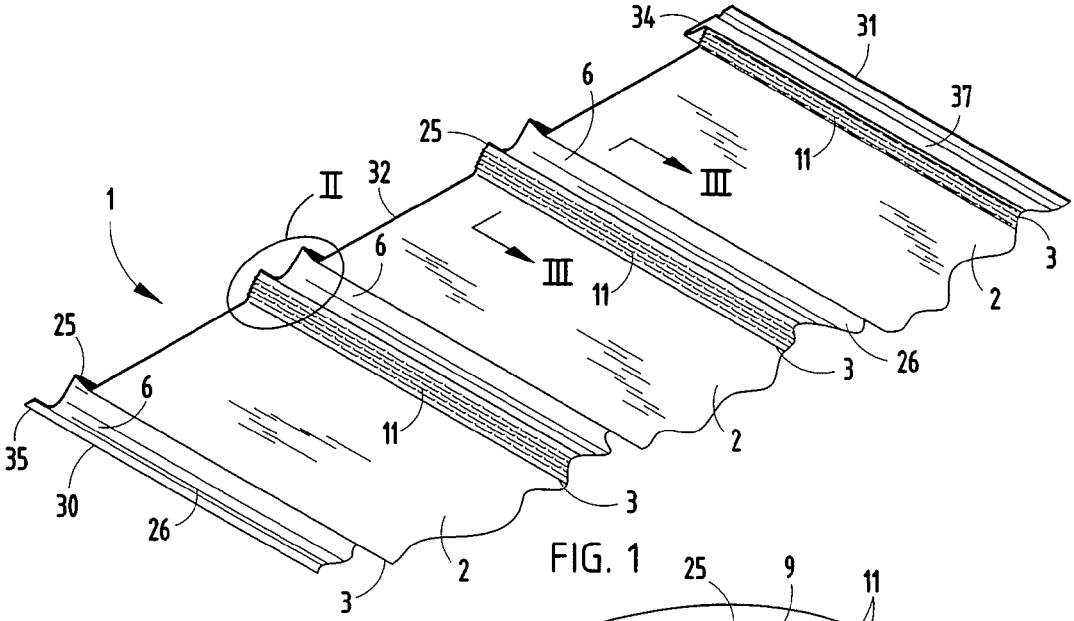
FIG. 1 is a fragmentary perspective view of a beaded soffit panel embodying the present invention.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a beaded soffit panel embodying the present invention. In the illustrated example, beaded soffit panel 1 includes a plurality of generally flat, integrally formed imperforate base portions 2 extending longitudinally along soffit panel 1, with opposite sides 3 arranged in a mutually parallel, laterally spaced apart and coplanar relationship to enclose at least a portion of an associated soffit 4 (FIG. 10) when beaded soffit panel 1 is mounted in a generally horizontal orientation under an associated eave 5. A plurality of generally M-shaped, integrally formed contoured bead portions 6 (FIGS. 1-3) are disposed between the opposite sides 3 of base portions 2 and have pairs of generally flat, oppositely inclined sidewalls 7 with exterior and interior faces 8 and 9, as well as center walls 10 extending between sidewalls 7 to create a decorative external appearance on beaded soffit panel 1. A plurality of integrally formed, narrow, elongate vent slits 11, configured to permit ambient air to flow therethrough to vent the eave, extend through the exterior faces 8 of the sidewalls 7 of bead portions 6 at a predetermined acute angle therewith to define angled tabs 12 that extend inwardly from the interior faces 9 of the sidewalls 7 at the predetermined acute angle relative to the sidewall 7. When the beaded soffit panel 1 is installed in a generally horizontal orientation, vision through the vent slits 11 from a position generally underneath the eave 5 is substantially blocked by the angled tabs 12.

Figure 10:
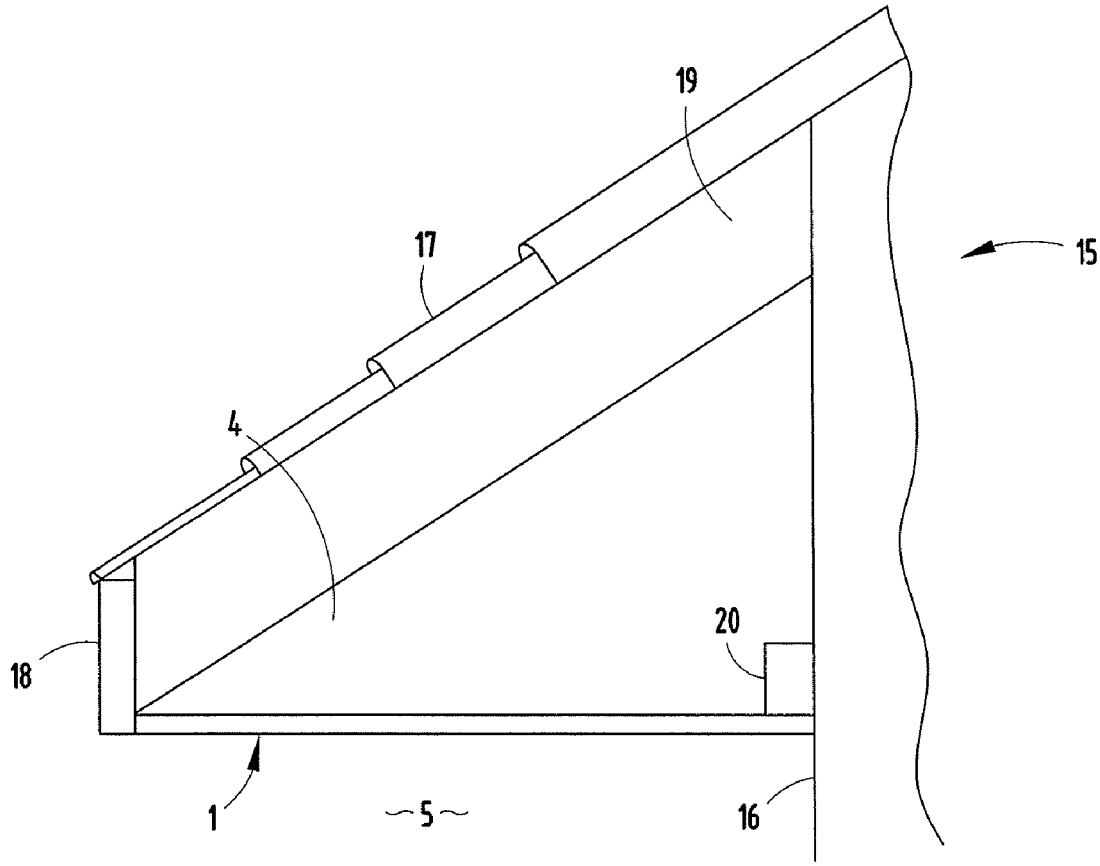
FIG. 10 is a partially schematic view of a roof eave with the beaded soffit panel installed therein.

In the example illustrated in FIG. 10, building 15 has a substantially conventional construction, comprising an exterior wall 16 and an inclined roof 17 which protrudes over exterior wall 16 to define eave 5. A fascia board 18 extends along the lower edge of roof 17, depends downwardly therefrom, and is typically fastened to the ends of the rafters 19. A ledger board 20 is attached to the exterior wall 16 of building 15 at a location generally horizontally aligned with the bottom of the fascia board 18. Beaded soffit panels 1 are positioned in a side-by-side relationship beneath the overhang or eave 5, and extend from fascia board 18 to ledger board 20 to enclose the underside of eave 5 and define soffit 4, which communicates with the attic (not shown) of building 15.

Figure 2:
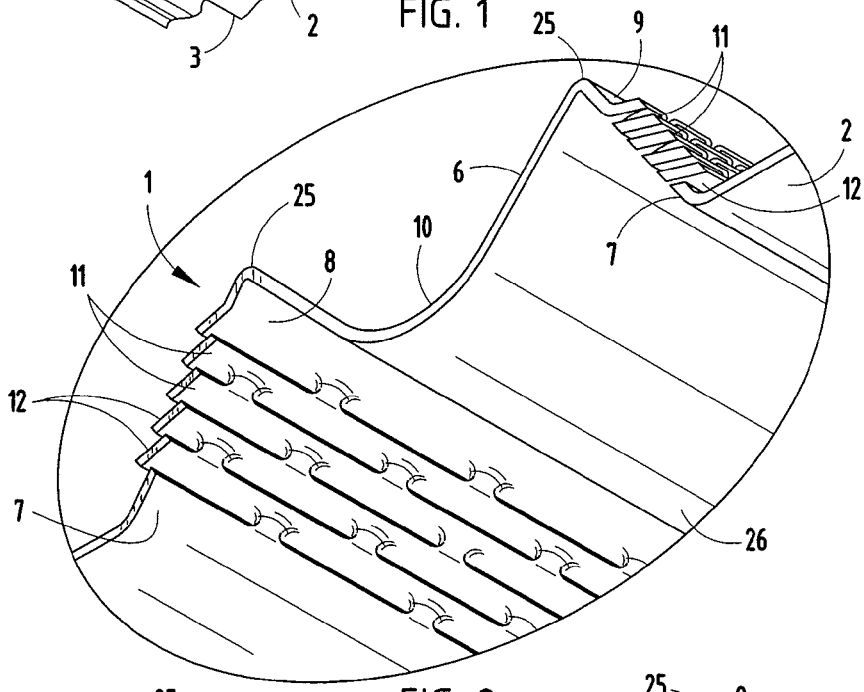
FIG. 2 is an enlarged, fragmentary view of the soffit panel, taken from the balloon II, FIG. 1.
Figure 3:
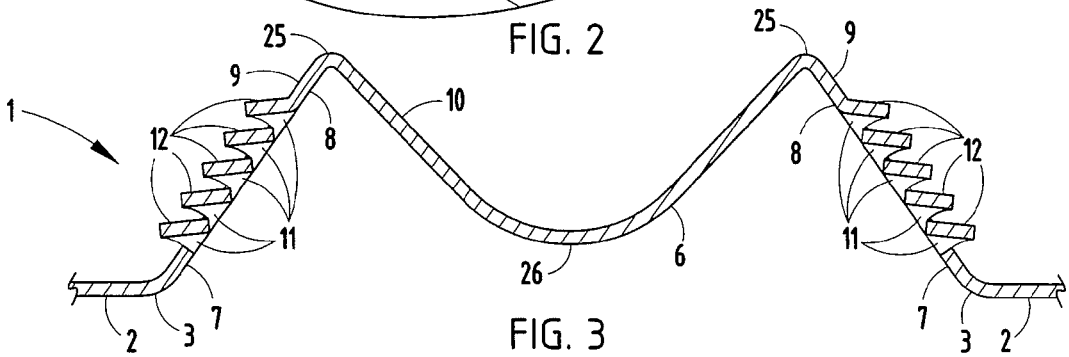
FIG. 3 is an enlarged, fragmentary vertical cross-sectional view of the soffit panel.
Figure 8:
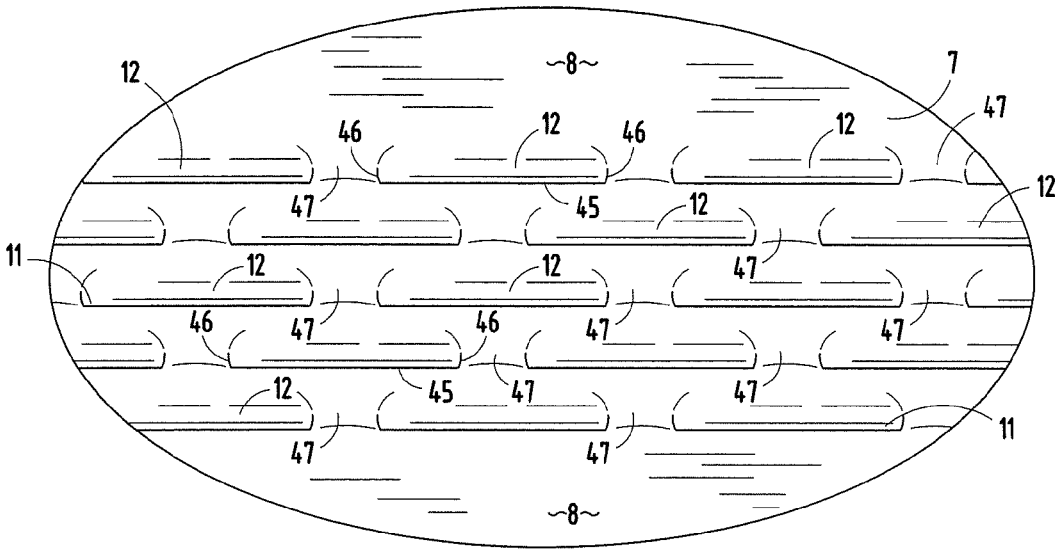
FIG. 8 is a fragmentary, enlarged top plan view of the surface of the bead sidewall and vent slits taken from the balloon VIII, FIG. 7.
Figure 9:
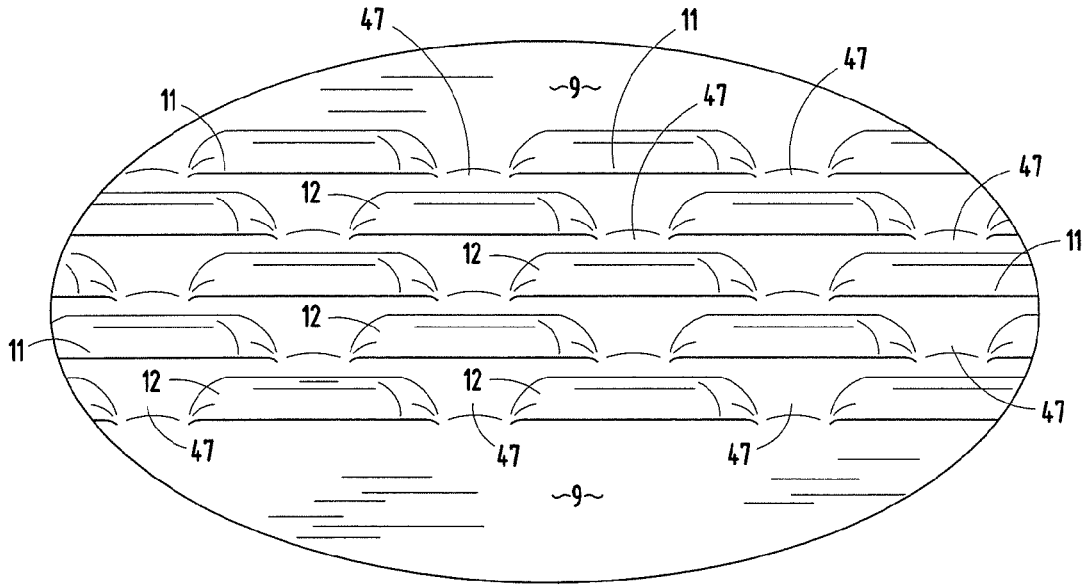
FIG. 9 is a fragmentary, enlarged bottom plan view of the bead sidewall and vent slits shown in FIG. 8.

In the illustrated example, beaded soffit panel 1 preferably has an integrally formed, one-piece construction made of formed sheet metal, such as steel, aluminum or the like. With reference to FIGS. 1-3, in the illustrated beaded soffit panel 1, the exterior faces 8 of the sidewalls 7 of bead portions 6 are substantially flat, and planar along the vent slits 11 so as to facilitate obscuring the vent slits from view. Furthermore, the sidewalls 7 of bead portions 6 are disposed at an angle to the base portions 2 to define an included angle therebetween in the range of 100 to 130 degrees. Preferably, the predetermined acute angle of the vent slit tabs 12 is in the range of 30 to 60 degrees relative to the sidewalls 7. In the soffit panel 1 shown in FIG. 3, which is disposed in a generally horizontal orientation, tabs are inclined downwardly slightly relative to the horizontal in the range of 0-10 degrees, and preferably around 5 degrees, so as to facilitate obscuring vent slits 11 from view. In the illustrated example, the vent slits 11 are arranged in a plurality of side-by-side, longitudinally staggered rows, as best shown in FIGS. 8 and 9, to facilitate obscuring the vent slits from view. In the example illustrated in FIGS. 1-5, the center walls 10 on bead portions 6 have an arcuate shape which extends downwardly toward the base portions 2 a predetermined distance. The edges 25 between arcuate center walls 10 and sidewalls 7 are rounded to enhance the aesthetics of the beaded soffit panel 1. Furthermore, edges 26 between base portions 2 and sidewalls 7 are also rounded.

In one working embodiment of the present invention, each bead sidewall 7 has five rows of vent slits 11, which are positioned adjacent one another in a longitudinally offset, symmetrically staggered relationship, wherein each of the vent slits 11 has a length in the range of 0.300-0.400 inches and a width in the range of 0.0300-0.0400 inches, as measured between adjacent ones of the angled tabs 12. With reference to FIGS. 8 and 9, in the illustrated embodiment, vent slits 11 have straight side edges 45 and arcuate end edges 46, with the spaces 47 between the end edges 46 of longitudinally aligned vent slits 11 being in the range of 0.0600-0.0700 inches, and the lateral distance between the centers of adjacent rows of vent slits 11 being in the range of 0.0600-0.0700 inches. In the working embodiment, the angled tabs 12 have a length in the range of 0.300-0.400 inches, a width in the range of 0.0600-0.0700 inches. In the working embodiment, the distance between top edges 25 of sidewalls 7 and the base portions 2 is in the range of 0.300-0.400 inches, and the distance between the lowermost edges 26 of center walls 10 and the base portions 2 is in the range of 0.0600-0.0700 inches. In the subject working embodiment, the distance between adjacent sides 3 at bead portions 6 is in the range of 1.00-1.250 inches, and the associated distance between edges 25 is 0.70-0.80 inches, while the length of sidewalls 7 is in the range of 0.350-0.400 inches.

Figure 4:
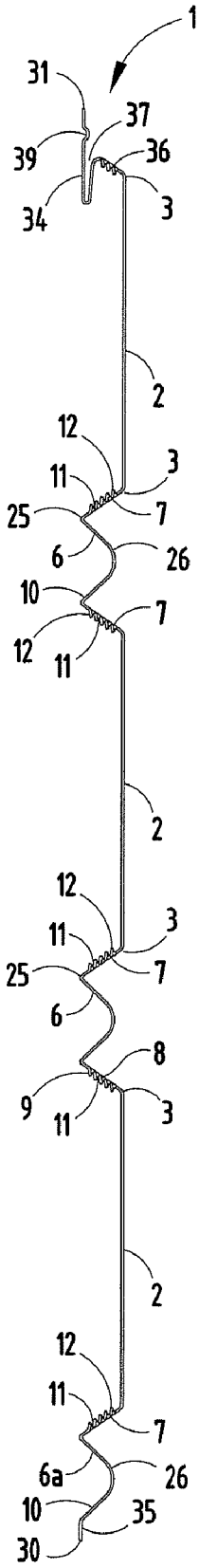
FIG. 4 is an end view of the beaded soffit panel.
Figure 5:
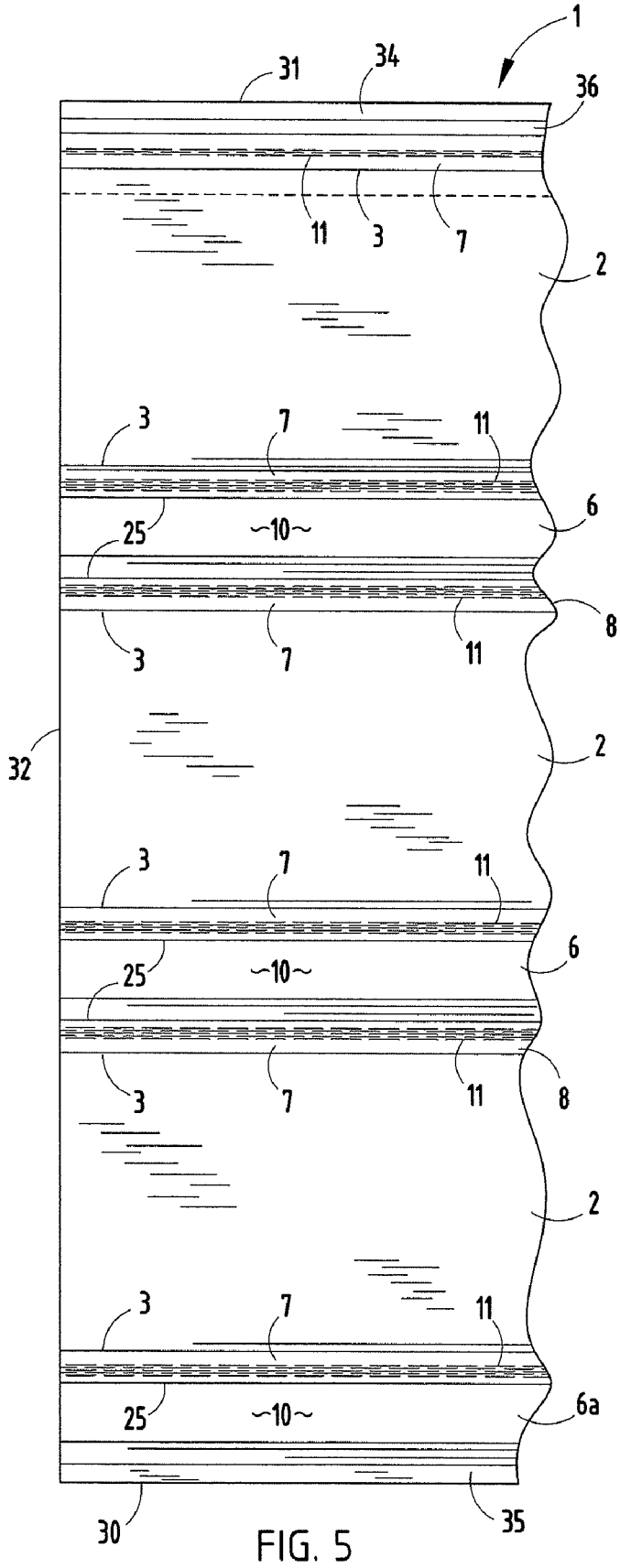
FIG. 5 is a fragmentary bottom plan view of the beaded soffit panel.

With reference to FIGS. 4 and 5, the illustrated beaded soffit panel 1 has a substantially rectangular plan configuration, defined by side edges 30 and 31, and opposite edges 32. The illustrated beaded soffit panel 1 also includes a plurality of bead portions 6 extending along the length of beaded soffit panel 1. More specifically, the beaded soffit panel 1 illustrated in FIGS. 4 and 5 includes three flat panels or base portions 2 with two full bead portions 6 and one half bead portion 6*a* which extend along the beaded soffit panel 1 in a mutually spaced apart relationship. Furthermore, the illustrated beaded soffit panel 1 includes connector flanges 34 and 35, which extend along the side edges 31 and 30, respectively, of beaded soffit panel 1. Connector flange 34 includes an inclined sidewall 36, whose shape, size and orientation are substantially identical to the sidewalls 7 of bead portions 6. Connector flange 34 also includes a narrow receptor slot 37, formed by overlapping portions of connector flange 34, which is shaped to receive therein the connector flange 35 of an adjacent beaded soffit panel 1. The top wall of connector flange 34 is coplanar with the top wall of connector flanges 35 and includes a downwardly oriented protrusion or detent 39 adjacent the free end thereof which is adapted to abut and frictionally engage the connector flange 35 of the next adjacent beaded soffit panel 1 to securely interconnect the same in a side-by-side relationship. The sidewall 36 of connector flange 35 is also vented with slits 11 in a manner similar to the sidewall 7 of bead portion 6 to provide additional venting. Half bead portion 6*a* also includes an inclined sidewall 7, which is similar in shape, size and orientation to sidewalls 7 of full bead portions 6, and is provided with vent slits 11 for additional venting.

As will be apparent to those skilled in the art, the specific dimensions of beaded soffit panels 1, base portions 2, bead portions 6 and vent slits 11, along with the other features of the present invention noted above, can be varied substantially to accommodate for a wide variety of different applications.

Figure 6:
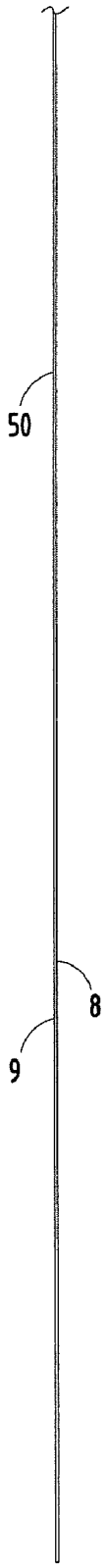
FIG. 6 is an end view of the beaded soffit panel blank shown in a developed state prior to being formed.
Figure 7:
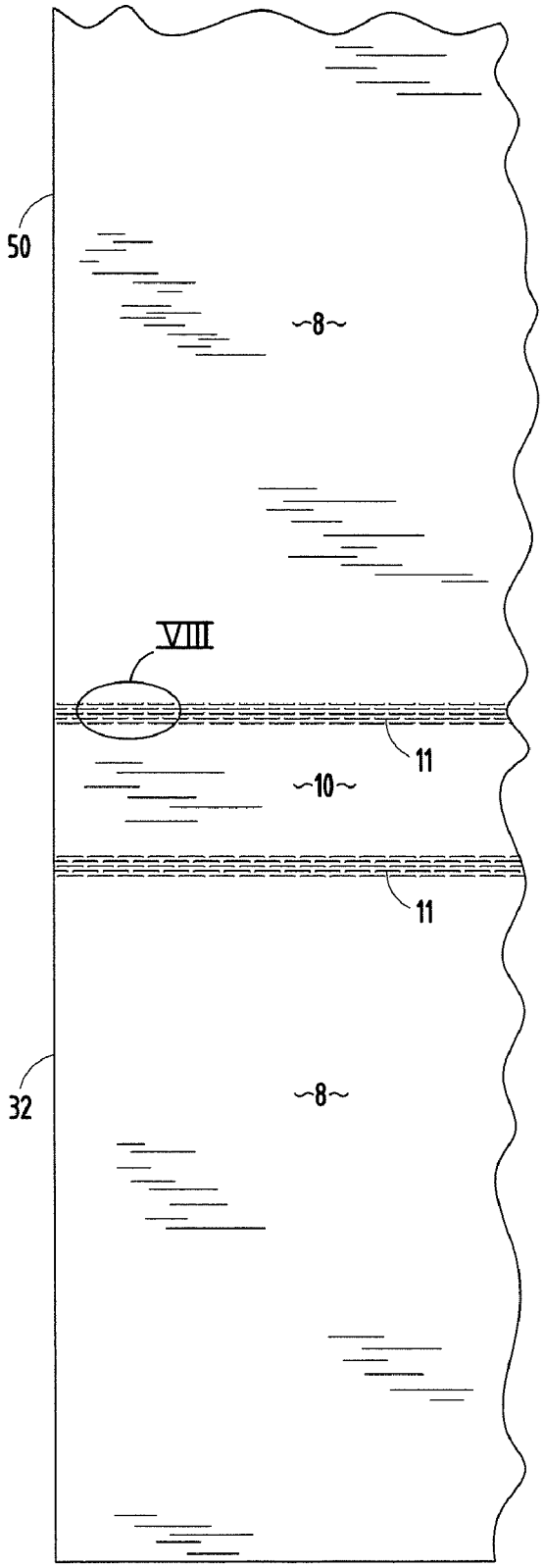
FIG. 7 is a bottom panel view of the beaded soffit panel blank shown after forming two rows of vent slits.
Figure 7A:
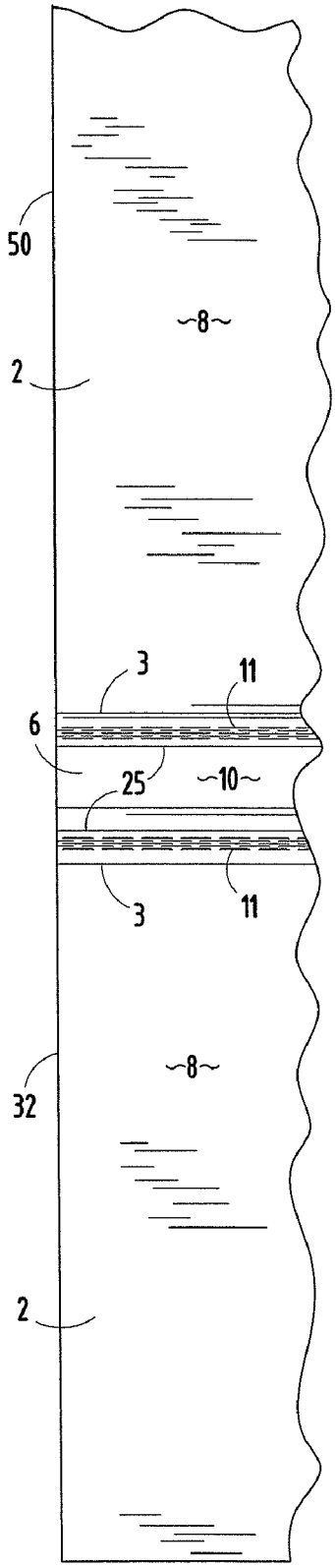
FIG. 7A is a bottom plan view of the beaded soffit panel blank shown after forming one bead along the two rows of vent slits.

With reference to FIGS. 6 and 7, in one working embodiment of the present invention, beaded soffit panel 1 is made in the following manner. A strip 50 of sheet metal, such as steel, aluminum or the like, is first uncoiled and straightened into a flat condition, as shown in FIG. 6. The straightened strip 50 of sheet metal is then microlanced in the flat condition at the location of one of the two full bead portions 6 to form two parallel rows of vent slits 11 along the opposite sides of the developed or flat center wall area 10 of the selected full bead portions 6, as shown in FIG. 7. The microlancing process forms each of the tabs 12 inwardly from the flat exterior face of the sheet metal strip, so that the tabs 12 protrude inwardly, thereby leaving the exterior surface 8 of the strip 50 flat and planar. The microlanced strip 50 shown in FIG. 7 is then roll formed in the area of the strip 50 where the two rows of vent slits 11 were formed, so as to create the bead portion 6 with inclined sidewalls 7 and arcuate center wall 10, as shown in FIG. 7A. Next, the other full bead portion 6 is similarly formed by microlancing two more rows of vent slits 11 in the flat part of the strip 50, and subsequently roll forming the strip 50 in the area of the second pair of vent slits 11 to create the second full bead portion 6 with inclined sidewalls 7 and arcuate center wall 10. Next, two more rows of vent slits 11 are formed in the flat parts of the strip 50 adjacent connector flanges 34 and 35. The sidewall 7, half bead 6*a* and center wall 10 along edge 30 are then roll formed into the blank, along with the sidewall 36, slot 37 and detent 39 along edge 31. After strip 50 has been fully formed into the desired shape or profile of beaded soffit panel 1, the strip 50 is then cut to length to create the individual panels 1.

Beaded soffit panels 1 are installed under the eave 5 of building roof 17 in the following manner. The rearward end edge 32 of each beaded soffit panel 1 is positioned along ledger board 20 with the sidewalls 7 of bead portions 6 oriented upwardly. The forward end edge 32 of each beaded soffit panel 1 is positioned along the interior surface of fascia board 18, and may be attached to the same, as well as to the lower surface of the rafters 19. Beaded soffit panels 1 are arranged in a side-by-side fashion, with the connector flange 35 of each beaded soffit panel 1 being inserted into the slot 37 in the connector flange 34 of the next adjacent beaded soffit panel 1, so as to interconnect the same in a substantially flat or coplanar condition. When beaded soffit panels 1 are so installed in a generally horizontal orientation under eave 5, vision through the vent slits 11 from a position generally underneath the eave 5 is substantially blocked by the angled tabs 12, thereby obscuring the same from view, so as to greatly improve the aesthetics of the building construction.

Beaded soffit panel 1 provides improved aesthetics, includes vent slits 11 which are obscured from view, yet permits air to flow therethrough and prevents insects, bugs and other debris from entering the soffit 4 or eave 5. The beaded soffit panel 1 has an uncomplicated design, is easy to install, economical to manufacture, and very durable.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A beaded soffit panel for building roofs of the type having at least one eave with a soffit thereunder, comprising:

a plurality of generally flat, integrally formed imperforate base portions extending longitudinally along said soffit panel, with opposite sides thereof arranged in a mutually parallel, laterally spaced apart and coplanar relationship to enclose at least a portion of the soffit when said soffit panel is mounted in a generally horizontal installed orientation under the eave;

a plurality of integrally formed, contoured bead portions disposed between said opposite sides of said base portions and having a generally M-shaped configuration when in said installed orientation under the eave defined by pairs of generally flat, oppositely inclined sidewalls with exterior faces oriented away from the soffit and interior faces oriented toward the soffit, and center walls extending between said sidewalls to create a decorative external appearance on said soffit panel; and a plurality of integrally formed, narrow, elongate vent slits configured to permit ambient air to flow therethrough to vent the eave, and extending through said exterior faces of said sidewalls of said bead portions at a predetermined acute angle therewith to define angled tabs that extend from said interior faces of said sidewalls inwardly away from said center walls at said predetermined acute angle relative to said sidewalls, whereby when said soffit panel is installed in said generally horizontal installed orientation, vision through said vent slits from a position generally underneath the eave is substantially blocked by said angled tabs.

2. A beaded soffit panel as set forth in claim 1, wherein: said exterior faces of said sidewalls of said bead portions are substantially flat and planar along said vent slits to facilitate obscuring said vent slits from view.

3. A beaded soffit panel as set forth in claim 2, wherein: said sidewalls of said bead portions are disposed at an angle to said base portions to define an included angle therebetween in the range of 110-130 degrees.

4. A beaded soffit panel as set forth in claim 3, wherein: said predetermined acute angle of said vent slit tabs is in a range of 30-60 degrees relative to said sidewalls.

5. A beaded soffit panel as set forth in claim 4, wherein: said base portions are disposed in a coplanar relationship to define a predetermined bottom plane of said soffit panel.

6. A beaded soffit panel as set forth in claim 5, wherein: said soffit panel is constructed from sheet metal.

7. A beaded soffit panel as set forth in claim 6, wherein: said vent slits are arranged in a plurality of side-by-side, longitudinally staggered rows to facilitate obscuring said vent slits from view.

8. A beaded soffit panel as set forth in claim 7, wherein: said center walls on said bead portions have an arcuate shape.

9. A beaded soffit panel as set forth in claim 8, wherein: said vent slits have a width in the range of 0.0300-0.0500 inches, as measured between adjacent ones of said angled tabs.

10. A beaded soffit panel as set forth in claim 9, wherein: said vent slits have a length in the range of 0.300-0.400 inches.

11. A beaded soffit panel as set forth in claim 10, wherein: said angled tabs have a length in the range of 0.0600-0.0700 inches.

12. A beaded soffit panel as set forth in claim 1, wherein: said sidewalls of said bead portions are disposed at an angle to said base portions to define an included angle therebetween in the range of 110-130 degrees.

13. A beaded soffit panel as set forth in claim 1, wherein: said predetermined acute angle of said vent slit tabs is in a range of 30-60 degrees relative to said sidewalls.

14. A beaded soffit panel as set forth in claim 1, wherein: said vent slits are arranged in a plurality of side-by-side, longitudinally staggered rows to facilitate obscuring said vent slits from view.

15. A beaded soffit panel for building roofs of the type having at least one eave with a soffit thereunder, comprising:

a plurality of generally flat, integrally formed imperforate base portions extending longitudinally along said soffit panel, with opposite sides thereof arranged in a mutually parallel, laterally spaced apart and coplanar relationship to enclose at least a portion of the soffit when said soffit panel is mounted in a generally horizontal installed orientation under the eave;

a plurality of integrally formed, contoured bead portions disposed between said opposite sides of said base portions and having pairs of generally flat, oppositely inclined sidewalls extending generally vertically when in said installed orientation under the eave with exterior faces oriented away from the soffit and interior faces oriented toward the soffit, and center walls extending between said sidewalls to create a decorative external appearance on said soffit panel; and a plurality of integrally formed, narrow, elongate vent slits configured to permit ambient air to flow therethrough to vent the eave, and extending through said exterior faces of said sidewalls at a predetermined acute angle therewith to define angled tabs that extend from said interior faces of said sidewalls inwardly away from said center walls at said predetermined acute angle relative to said sidewalls, whereby when said soffit panel is installed in said generally horizontal installed orientation, vision through said vent slits from a position generally underneath the eave is substantially blocked by said angled tabs.

16. A beaded soffit panel as set forth in claim 15, wherein: said exterior faces of said sidewalls of said bead portions are substantially flat and planar along said vent slits to facilitate obscuring said vent slits from view.

17. A beaded soffit panel as set forth in claim 15, wherein: said sidewalls of said bead portions are disposed at an angle to said base portions to define an included angle therebetween in the range of 110-130 degrees.

18. A beaded soffit panel as set forth in claim 15, wherein: said predetermined acute angle of said vent slit tabs is in a range of 30-60 degrees relative to said sidewalls.

19. A beaded soffit panel as set forth in claim 18, wherein: said vent slits are arranged in a plurality of side-by-side, longitudinally staggered rows to facilitate obscuring said vent slits from view.

* * * * *